US010238254B2

(12) United States Patent
Roschi

(10) Patent No.: US 10,238,254 B2
(45) Date of Patent: Mar. 26, 2019

(54) BASE PLATE FOR A SUCTION HEAD FOR VACUUM CLEANERS OR THE LIKE

(71) Applicant: NEW ERMES EUROPE S.R.L., Crosio Della Valle (VA) (IT)

(72) Inventor: Riccardo Roschi, Crosio Della Valle (IT)

(73) Assignee: NEW ERMES EUROPE S.R.L., Crosio Della Valle (VA) (IT)

( * ) Notice: Subject to any disclaimer, the term of this patent is extended or adjusted under 35 U.S.C. 154(b) by 20 days.

(21) Appl. No.: 15/435,322

(22) Filed: Feb. 17, 2017

(65) Prior Publication Data

US 2017/0238774 A1 Aug. 24, 2017

(30) Foreign Application Priority Data

Feb. 19, 2016 (IT) ..... 102016000017600

(51) Int. Cl.
*A47L 9/02* (2006.01)
*A47L 7/00* (2006.01)

(52) U.S. Cl.
CPC ..... *A47L 9/02* (2013.01); *A47L 7/0009* (2013.01)

(58) Field of Classification Search
CPC ..... A47L 9/02; A47L 7/0009
See application file for complete search history.

(56) References Cited

U.S. PATENT DOCUMENTS

| | | | | |
|---|---|---|---|---|
| 6,101,668 A * | 8/2000 | Grey | A47L 7/0009 15/322 |
| 2007/0143954 A1* | 6/2007 | Graham | A47L 9/0477 15/364 |
| 2014/0033473 A1 | 2/2014 | McVey | |

FOREIGN PATENT DOCUMENTS

| | | | |
|---|---|---|---|
| DE | 19906137 C1 * | 7/2000 | A47L 9/02 |
| EP | 1116470 A1 * | 7/2001 | A47L 9/06 |
| EP | 1210898 A1 * | 6/2002 | A47L 9/02 |
| EP | 1595485 A1 * | 11/2005 | A47L 9/02 |
| GB | 2 471 918 | 1/2011 | |
| GB | 2 496 663 | 5/2013 | |
| WO | WO 2005/096907 | 10/2005 | |

* cited by examiner

*Primary Examiner* — Dung Van Nguyen
(74) *Attorney, Agent, or Firm* — Nixon & Vanderhye P.C.

(57) ABSTRACT

A base plate for a suction head for vacuum cleaners or a similar electric household appliance is described, said base plate comprising a lower face configured as to be directed towards the surface to be vacuumed, an opposite upper surface and a base plate channel open towards the surface to be vacuumed, wherein the base plate channel comprises a front edge and a rear edge, wherein at least the surface of the lower face which extends along the front edge of the base plate channel and at least the surface of the lower face which extends along the rear edge of the base plate channel lie in a same plane.

14 Claims, 7 Drawing Sheets

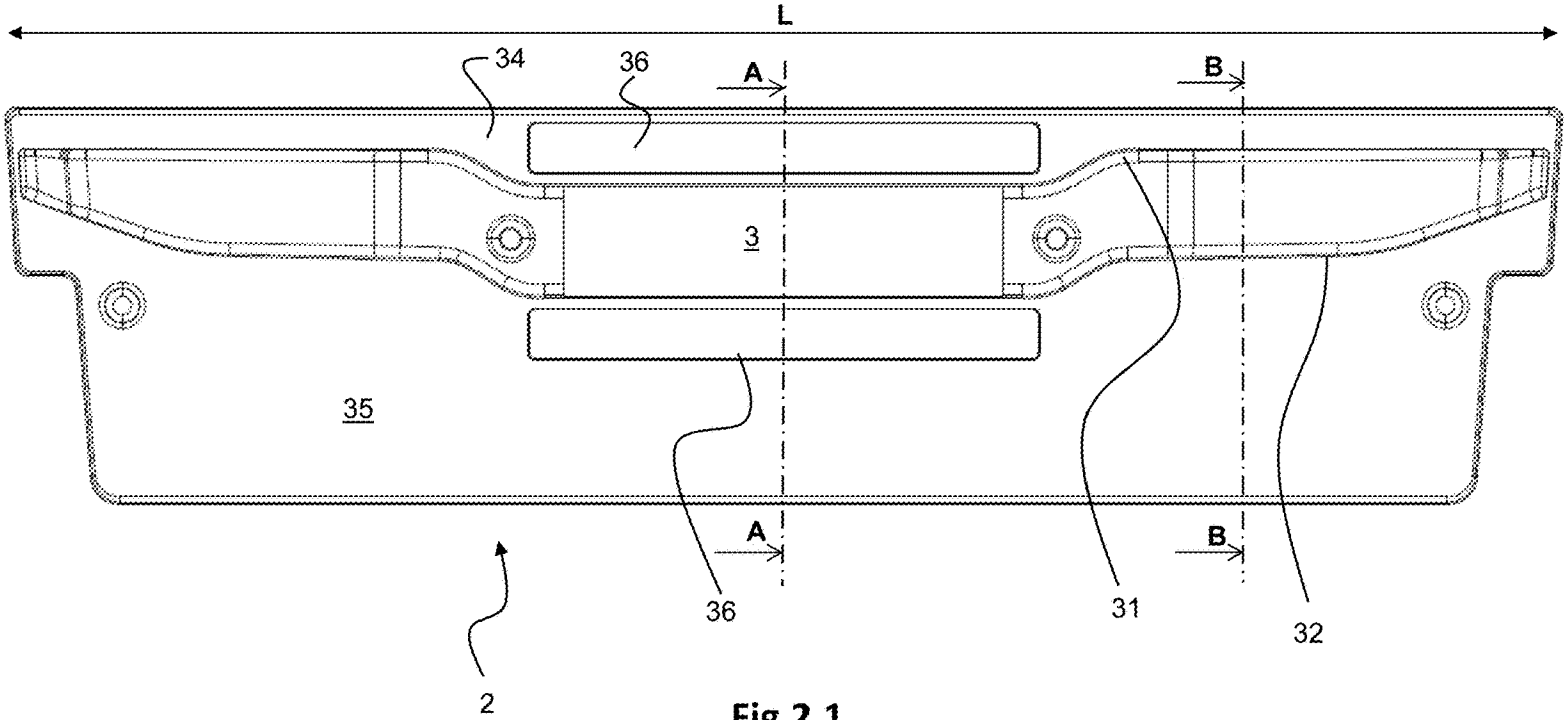
Fig.2.1

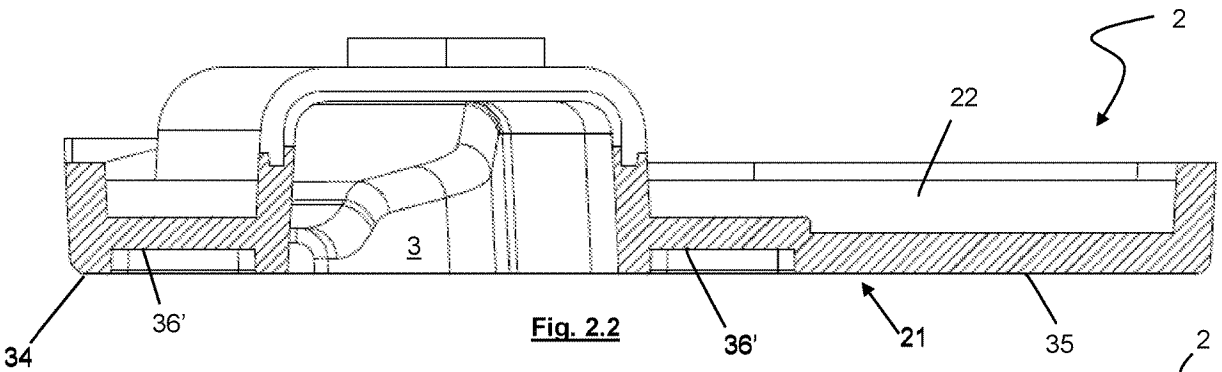
Fig. 2.2
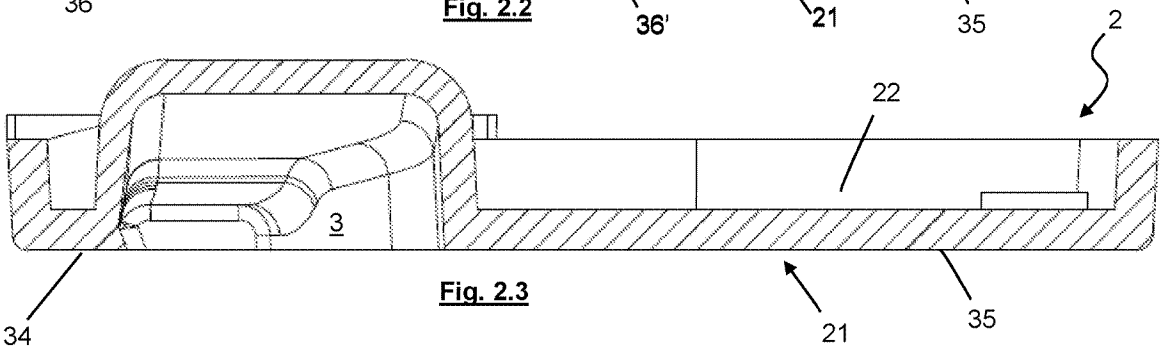
Fig. 2.3
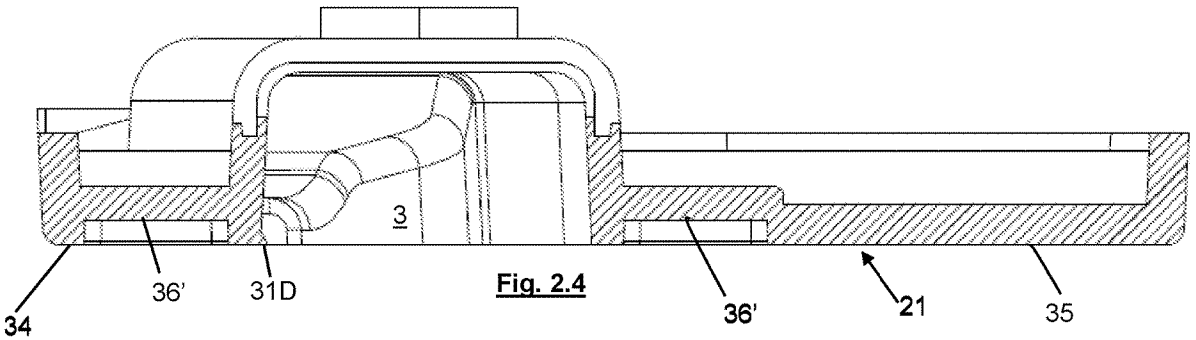
Fig. 2.4

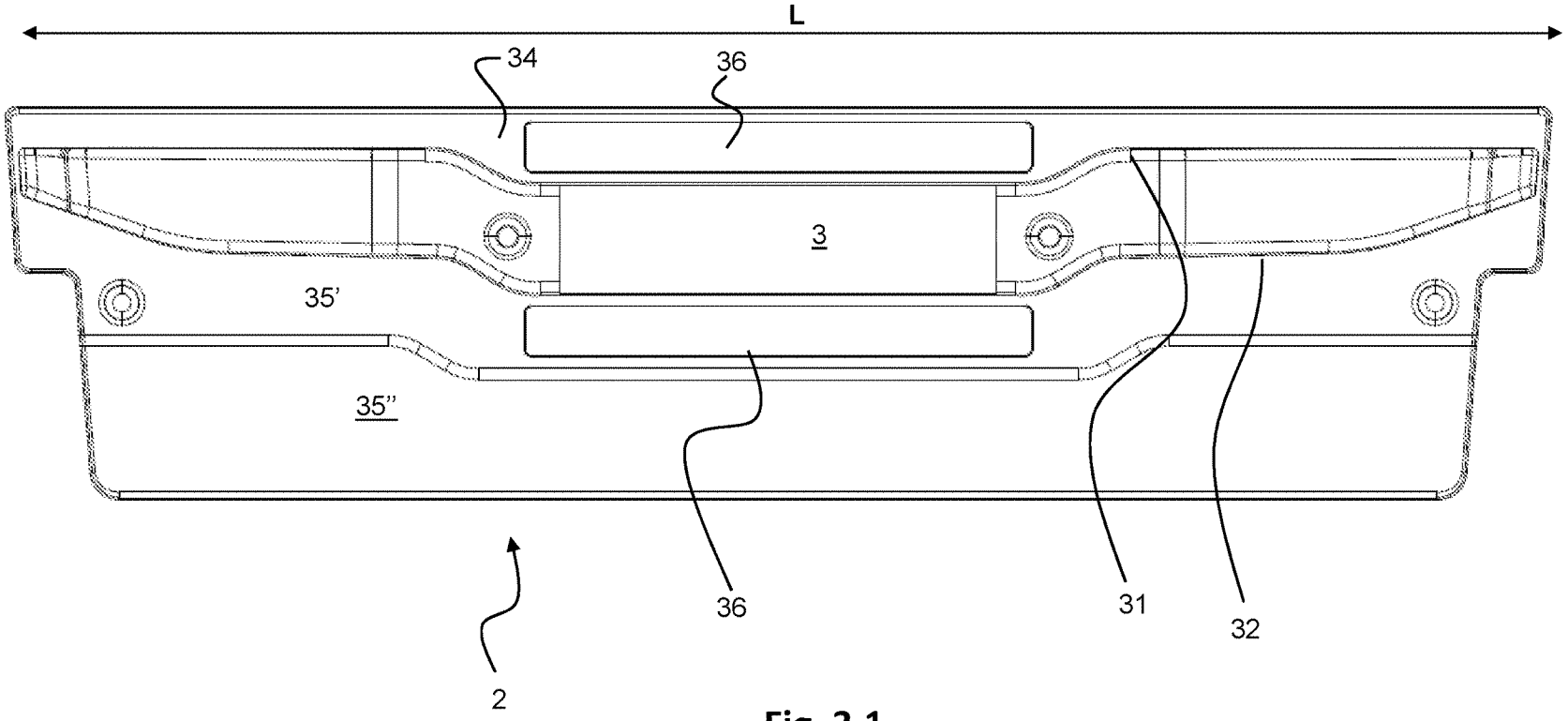
Fig. 3.1

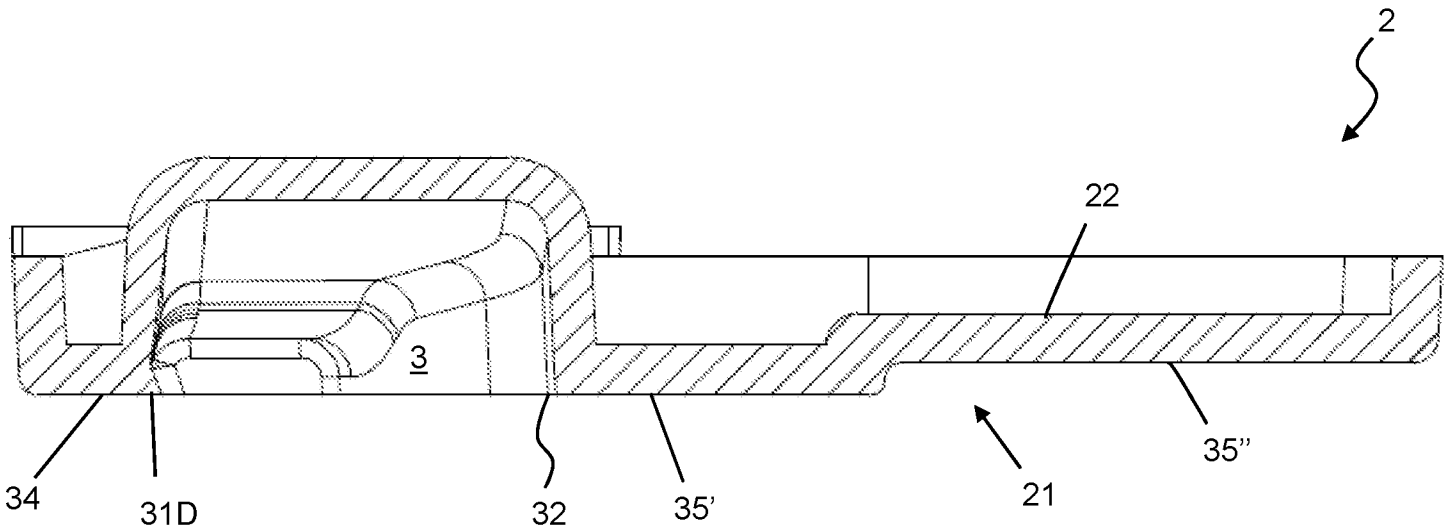
Fig. 3.2

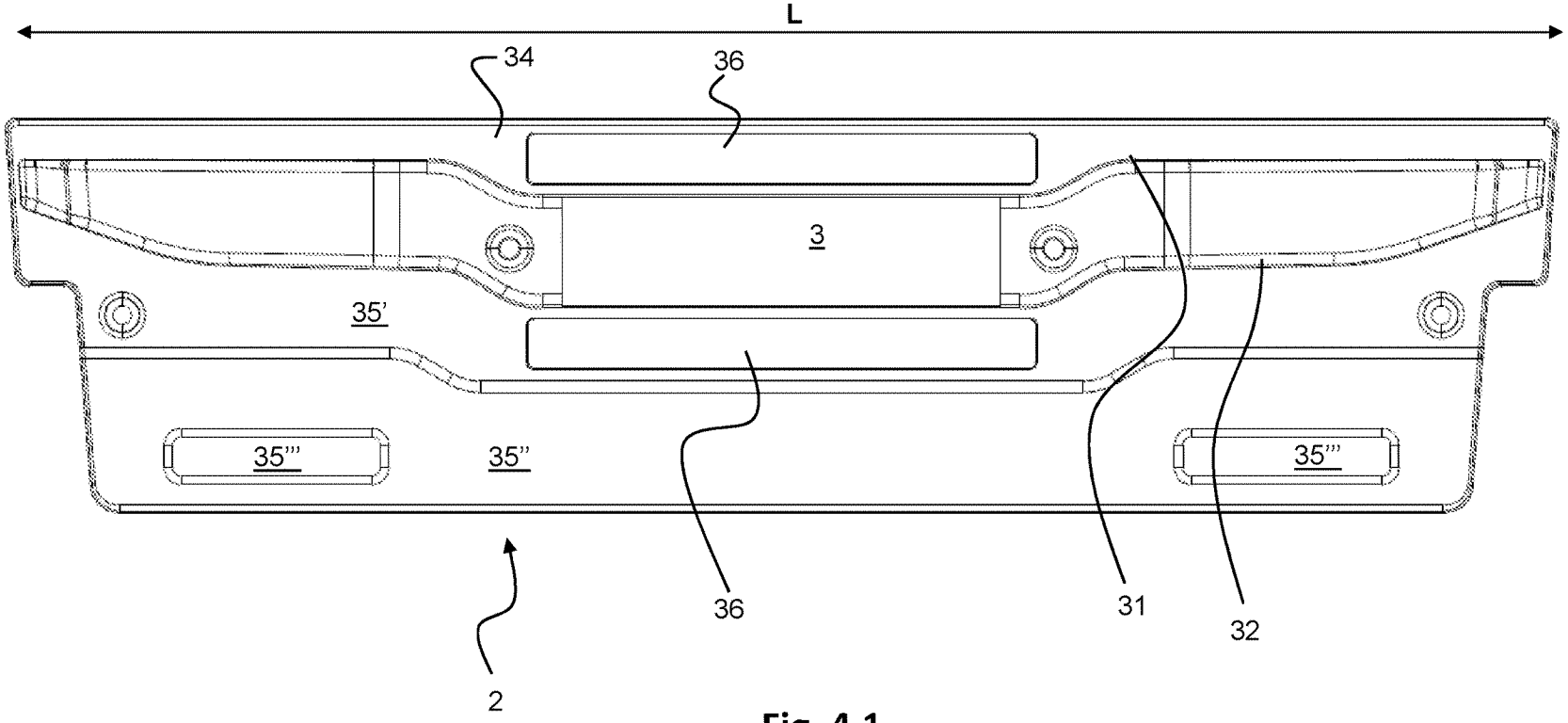
Fig. 4.1

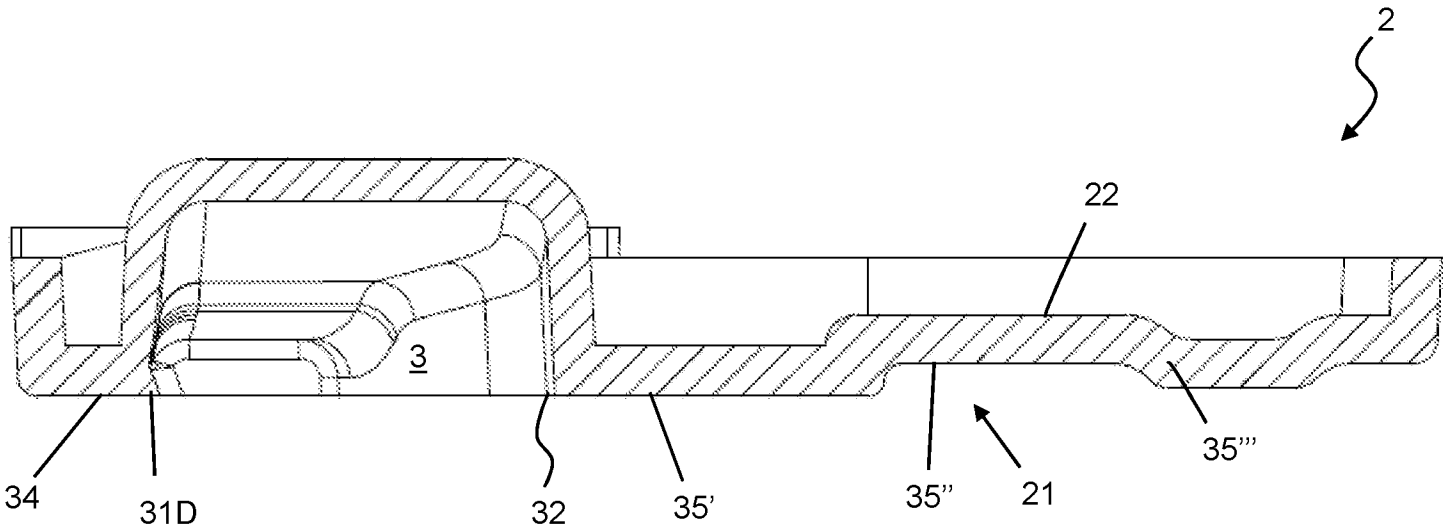
Fig. 4.2

BASE PLATE FOR A SUCTION HEAD FOR VACUUM CLEANERS OR THE LIKE

This application claims priority to IT Patent Application No. 102016000017600 filed Feb. 19, 2016, the entire content of which is hereby incorporated by reference.

TECHNICAL FIELD

The present invention relates to the sector of electric household appliances for performing cleaning by means of suction, such as a vacuum cleaner, an electric broom or a multi-purpose drum vacuum cleaner, for sucking up dust and/or fluids and/or dirt from a surface. More particularly, it relates to a base plate for a suction head to be fitted to such an electric household appliance.

BACKGROUND

As is known, a vacuum cleaner, an electric broom or a similar electric household appliance for performing cleaning by means of suction comprises a suction head for sucking up dust, dirt or fluids from a surface. In the sector of electric household appliances, a suction head is generally referred to by the term "brush". For the purpose of the present description, therefore, the terms "suction head" and "brush" are considered to be equivalent. Again for the purpose of the present invention, the term "vacuum cleaner" will be used with a broad meaning so as to include all those apparatus, for professional or domestic use, which perform cleaning by means of suction. Therefore, the term "vacuum cleaner" will comprise a vacuum cleaner, an electric broom, a so-called multi-purpose drum vacuum cleaner, a centralized suction system for domestic or industrial use and an apparatus for supplying and sucking in steam.

Basically a known suction head comprises a base plate shaped so as to have at least one base plate channel open towards a surface to be vacuumed, a suction channel which, during use, is joined to the base plate and is in fluid communication with the base plate channel and optionally a covering body which can be connected to the base plate/suction channel assembly. The other end of the suction channel communicates with a suction tube usually via a rotatable joint. Also known are suction heads in which the suction channel, during use, is joined to the covering body.

In order to avoid an incorrect interpretation of certain expressions which will be frequently used during the course of the present description and in the claims, a number of definitions are provided hereinbelow:

- the expression "width" of a suction head, will be understood as meaning the maximum dimension (or footprint) of a suction head without the covering body and calculated substantially parallel to a longitudinal axis (or main longitudinal axis) of the base plate channel;
- the expression "suction efficiency" will be understood as meaning essentially the ratio, in percentage terms, of the vacuumed material to the material to be vacuumed; The vacuuming tests are carried out in accordance with the provisions of the standard EN 60312-1:2013-05.

GB 2 496 663 A discloses a cleaner head for a vacuum cleaner.

WO 2005/096907 A1 discloses a surface cleaning apparatus.

US 2014/033473 A1 discloses a floor tool for a vacuum cleaning apparatus.

GB 2 471 918 A discloses a surface treating head.

Although different suction heads which perform the function of sucking dust and/or fluids and/or dirt from a surface in a sufficiently efficient manner are available on the market, the Applicant has noticed that there exists the need to improve the performance of the known suction heads. In particular, the Applicant has noticed the need to increase the suction efficiency on carpets, rugs, doormats, matting or the like as well as on hard and substantially smooth surfaces such as floors consisting of marble, cement, resin, tiles, parquet or the like.

For many years, manufacturers have improved the performance of vacuum cleaners by increasing the power of the motors, without bothering about the associated increase in power consumption. By means of a high vacuuming power it has been possible to achieve an optimum vacuuming performance also without optimizing the various components of a vacuum cleaner brush.

At present, the existing standards which have been issued with the aim of reducing the power consumption, also in the sector of electric household appliances, have resulted in a substantial reduction in the power of electric household appliances and the need to optimize the components in order to ensure performance levels comparable to those of the preceding models.

SUMMARY

The Applicant has defined the object of improving substantially the suction efficiency of a conventional suction head on carpets, rugs, doormats, matting or the like, In this context, the Applicant has defined the object of providing a base plate shaped so as to provide an improved suction performance compared to the suction heads provided with a known suction plate, the suction power remaining the same.

According to the Applicant, the aforementioned object, along with others, may be achieved with a suction head able to reduce suction losses caused by poor adherence between the base plate and the surface to be vacuumed.

According to a first aspect of the present invention, a base plate for a vacuum cleaner comprising a lower face configured so as to be directed towards the surface to be vacuumed, an opposite upper face and a base plate channel open towards the surface to be vacuumed, wherein the base plate channel comprises a front edge and a rear edge, wherein said lower face consists of a single surface delimited by a perimeter comprising a front side, a rear side and two lateral sides, said single surface being completely closed except said base plate channel which is the sole aperture configured to suck up dust and/or fluids and/or dirt from said surface to be sucked, wherein said base plate, during use, is joined to a suction channel and said base plate channel is in fluid communication with the suction channel, wherein said base plate channel extends substantially through a whole width of said base plate and has closed ends in proximity of lateral sides of said base plate, wherein at least the surface of the lower face which extends along the whole front edge of the base plate channel and at least the surface of the lower face which extends along the whole rear edge of the base plate channel lie in a same plane.

According to a second aspect of the present invention, a suction head comprising a base plate with a base plate channel open towards a surface to be vacuumed, a suction channel in fluid communication with the base plate channel and a covering body connected to at least one of said base plate and said suction channel, wherein the base plate has a lower face configured so as to be directed towards the surface to be vacuumed, and an opposite upper face, wherein the base plate channel comprises a front edge and a rear edge, wherein said lower face consists of a single surface delimited by a perimeter comprising a front side, a rear side and two lateral sides, said single surface being completely closed except said base plate channel which is the sole aperture configured to suck up dust and/or fluids and/or dirt from said surface to be sucked, wherein said base plate channel extends substantially through a whole width of said base plate and has closed ends in proximity of lateral sides of said base plate, wherein at least the surface of the lower face which extends along the whole front edge of the base plate channel and at least the surface of the lower face which extends along the whole rear edge of the base plate channel lie in a same plane.

According to an advantageous embodiment of the invention, at least one further surface of the lower face not in the vicinity of the rear edge of the base plate channel lies in said same plane.

According to an advantageous embodiment of the invention, at least one further surface of the lower face not in the vicinity of the front edge of the base plate channel lies in said same plane.

According to a preferred embodiment of the invention substantially the whole of the lower face is flat and lies in said same plane.

BRIEF DESCRIPTION OF THE DRAWINGS

The invention will become clearer from the following detailed description, provided by way of a non-limiting example, to be read with reference to the accompanying drawings, in which:

FIG. 2.1 is a top plan view of the base plate according to FIG. 1;

FIGS. 2.2 and 2.3 are cross-sectional views along the lines A-A and B-B of FIG. 2.1;

FIG. 2.4 is a cross-sectional view similar to FIG. 2.2, but relating to a variant;

FIGS. 3.1 and 3.2 show a second embodiment of the invention; and

FIGS. 4.1 and 4.2 show a third embodiment of the invention.

DETAILED DESCRIPTION

Figure 1:
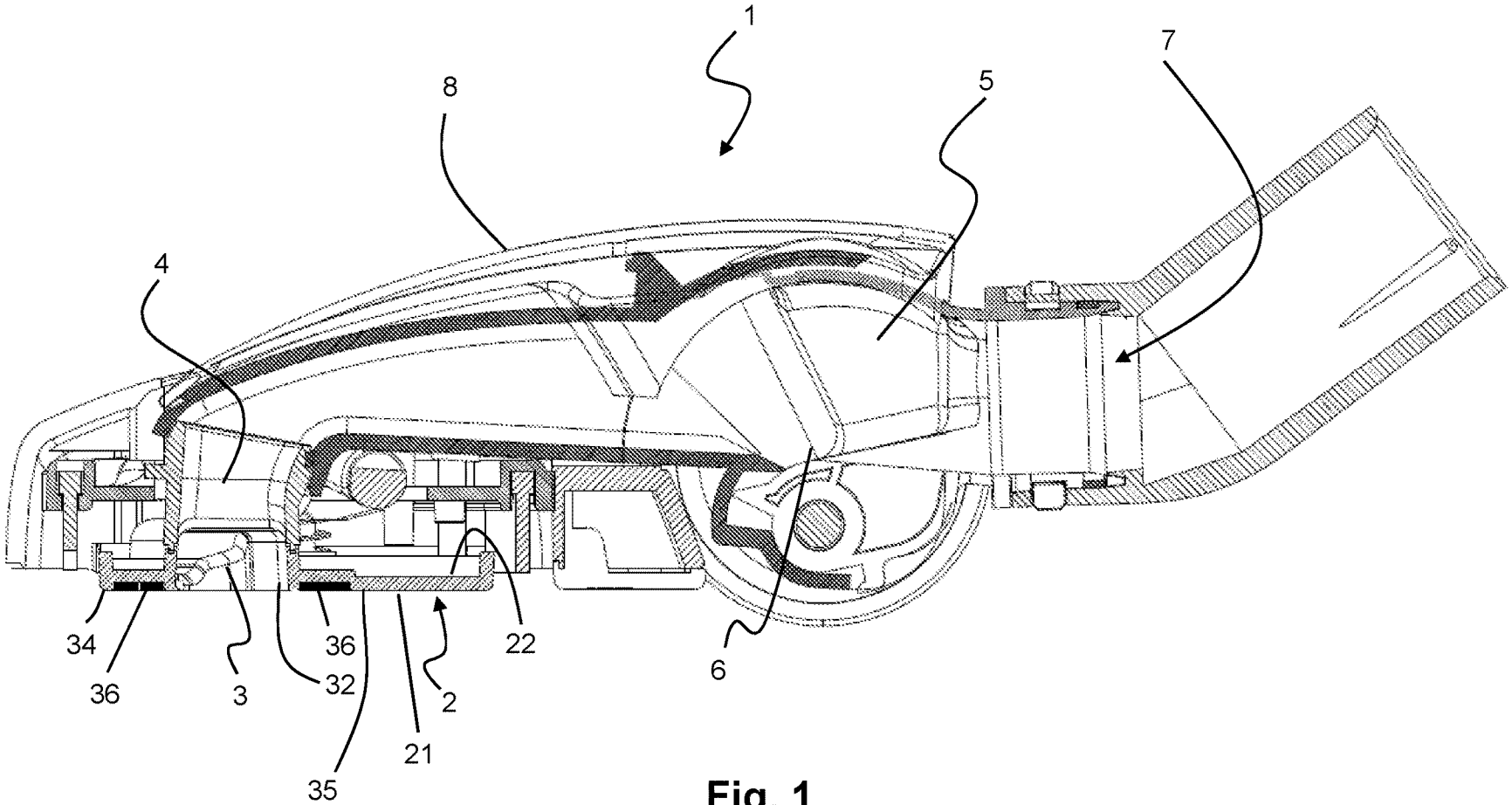
FIG. 1 is a view of a suction head with base plate according to an embodiment of the invention.

FIG. 1 shows by way of example an embodiment of a suction head 1 of a vacuum cleaner or the like with a base plate 2 mounted in accordance with an embodiment of the present invention.

The suction head 1 according to the invention is particularly suitable for vacuuming surfaces such as carpets, rugs, doormats, matting or the like. It is, however, also effective for smooth and compact surfaces such as floors made of stone (marble or the like), terracotta, clinker, cement, resin, tiles, parquet or the like, in particular when used together with bristles which may vary their configuration depending on the needs.

As shown in the various figures, the base plate has a lower face 21 directed towards the surface to be vacuumed and an opposite upper face 22 which is connected to the brush body 8 or to other components of the suction head.

The suction head 1 has a suction channel 4 which, during use, is joined to the base plate 2 and is in fluid communication with a base plate channel 3 and optionally a covering body which can be connected to the base plate and/or to the suction channel. The other end of the suction channel 3 communicates with a suction tube, usually via a rotatable joint 7.

Usually, the base plate of a known suction head has an inclined front surface departing from the front edge of the base plate channel and extending towards the front edge of the base plate. Usually, a known base plate also has an inclined rear surface departing from the rear edge of the base plate channel and extending towards the rear edge of the base plate. Therefore the surface of a known base plate is not flat. Therefore, the imprint of a known base plate does not coincide with the surface of the base plate. In contrast, in a base plate of an example embodiment, as shown in various figures, a base plate front surface and a base plate rear surface are provided. The base plate front surface and the base plate rear surface are substantially perpendicular to the plane in which lie both the surface of the lower face which extends along the whole front edge of the base plate channel and the surface of the lower face which extends along the whole rear edge of the base plate channel.

The form of such a known base plate gives rise to significant losses due to the imperfect adherence with the surface to be vacuumed and therefore most of the suction power is wasted.

A further drawback of the known base plates is the impossibility of correctly employing the strips of velvet. As is known, in fact, usually there are two strips of velvet, a front strip of velvet along the central part of the front inclined surface and a rear strip of velvet along the central part of the rear inclined surface. It can be easily understood that, in order to work properly, the two strips must be parallel to the surface to be vacuumed. In other words, the front strip of velvet works correctly only when its whole area rests on the ground and therefore the suction head is inclined so that the front inclined surface is parallel to the surface to be vacuumed. In all the other situations, the front velvet strip works partially or not all.

According to a first preferred embodiment of the present invention, the base plate has a completely flat surface 21. In other words, the entire surface of the lower face 21 of the base plate lies in a single plane. This embodiment is shown in FIGS. 2.1 to 2.4. Hence the front surface 34 and the rear surface 35 lie in a same plane, i.e. a horizontal plane.

For the purposes of the present invention, the expression "the entire surface of the base plate lies in a single plane" or "the entire surface of the base plate lies in a same plane" is understood as meaning that substantially the entire surface 21 of the base plate 2 lies in a single plane, with allowance for a tolerance of up to a ±5°, preferably not greater than ±3° and even more preferably not greater than ±1°. The base plate channel 3, any holes, cavities, depressions or the like must not be taken into consideration during calculation of the surface area. For example, holes for screws designed to connect the base plate to another component of the suction head are not considered.

According to this first preferred embodiment, there may be strips of velvet 36 (or other similar material) in (at least) the central part of the base plate channel 3. Preferably, there is a front strip of velvet 36 and a rear strip of velvet 36. These strips of velvet 36 are embedded and lie substantially in a surface parallel to the flat surface of the base plate.

FIG. 2.2 is a cross-sectional view along the line A-A of FIG. 2.1. The planarity between the front surface 34 (that between the front edge of the base plate and the front edge of the channel 3) and the rear surface 35 (that between the rear edge of the base plate and the rear edge of the channel 3) is evident. Also visible are the cavities 36' inside which the strips of velvet 36 are housed and fixed. The bottom of these cavities is substantially parallel to the plane of the surfaces 34 and 35 and therefore the strips of velvet also lie in the same plane as the surfaces 34 (front surface) and 35 (rear surface). A front cavity 36' and a rear cavity 36' are respectively space away from the front edge of the base plate channel 3 and the rear edge of the base plate channel 3, as shown in figures.

In other embodiments, the strips of velvet could also not lie in the same plane as the surfaces 34 and/or 35.

FIG. 2.3 is another cross-sectional view along the line B-B of FIG. 2.1.

FIG. 2.4 is a cross-sectional view similar to that of FIG. 2.2, but relates to a variant in which the front edge 31 of the channel 3 has a substantially triangular tooth 31D which helps separate the dust from the surface to be vacuumed. The tooth 31D extends towards the inside of the opening of the channel 3.

According to a second preferred embodiment of the present invention, the base plate has a completely flat surface in an area which extends along the front edge 31 of the base plate channel 3 and along its rear edge 32. In other words, only a part of the surface of the base plate, i.e. that around the edge 31+32 of the base plate channel, lies in a single plane. This embodiment is clearly shown in FIGS. 3.1 and 3.2. From these figures it is clear that not all the rear surface 35 is at the same level as the front surface 34. Only the portion 35' closer to the rear edge 32 lies in the same plane as the front surface 34. The other portion 35" lies in a plane different from that of the surfaces 34 and 35'.

According to preferred embodiments, the front flat surface 34 extends over the entire width L of the suction head and over a depth of between a few mm (3-6 mm) and 10-50 mm.

According to preferred embodiments, the rear flat surface 35' extends over the entire width of the suction head and over a depth of between a few mm (3-6 mm) and 10-50 mm.

According to a third preferred embodiment of the present invention (shown in FIGS. 4.1 and 4.2), the base plate has a completely flat surface in an area which extends along the front edge of the base plate channel and along its rear edge. Substantially in the same manner as the second embodiment (FIGS. 3.1 and 3.2). Moreover, along the remainder of the surface of the base plate there are separate areas 35'" which also lie in the same plane as the flat surface 34, 35' around the front edge 31 and the rear edge 32 of the channel of the base plate. These separate areas 35'" have the function of making the surface of the suction head more stable.

The separate areas 35'" may extend over the entire width of the suction head or only over a part thereof. They may have a length of between a few mm (3-6 mm) and a few tens of millimeters (10-50 mm).

The invention claimed is:

1. A base plate for a suction head for a vacuum cleaner comprising a lower face configured so as to be directed towards a surface to be vacuumed, an opposite upper face and a base plate channel open towards the surface to be vacuumed, wherein the base plate channel comprises a front edge and a rear edge, wherein said lower face consists of a single surface delimited by a perimeter comprising a front side, a rear side and two lateral sides, said single surface being completely closed except said base plate channel which is the sole aperture configured to suck up dust and/or fluids and/or dirt from said surface to be vacuumed, wherein said base plate, during use, is joined to a suction channel and said base plate channel is in fluid communication with the suction channel, wherein at least the surface of the lower face which extends along the whole front edge of the base plate channel and at least the surface of the lower face which extends along the whole rear edge of the base plate channel lie in a same plane, wherein said base plate channel extends substantially through a whole width of said base plate and has closed ends in proximity of lateral sides of said base plate and wherein said base plate further comprises a front cavity in the base plate front surface configured to accommodate a front strip of velvet, the front cavity being spaced away from the front edge of the base plate channel.

2. The base plate of claim 1, wherein at least one further surface of the lower face not in the vicinity of the rear edge of the base plate channel lies in said same plane.

3. The base plate of claim 1, wherein at least one further surface of the lower face not in the vicinity of the front edge of the base plate channel lies in said same plane.

4. The base plate of claim 1, wherein substantially the entire surface of the lower face is flat and lies in said same plane.

5. The base plate of claim 1, further comprising a rear cavity in the base plate rear surface configured to accommodate a rear strip of velvet, the rear cavity being spaced away from the rear edge of the base plate channel, and wherein bottoms of the front cavity and the rear cavity are parallel to the plane of the base plate front surface and the base plate rear surface.

6. The base plate of claim 1, further comprising a base plate front surface and a base plate rear surface, and wherein the base plate front surface and the base plate rear surface are substantially perpendicular to the plane in which lie both the surface of the lower the face which extends along the whole front edge of the base plate channel and the surface of the lower face which extends along the whole rear edge of the base plate channel.

7. The base plate of claim 1, further comprising a substantially triangular tooth formed on the front edge of the base plate channel to extend towards the base plate channel.

8. A suction head comprising a base plate with a base plate channel open towards a surface to be vacuumed, a suction channel in fluid communication with the base plate channel and a covering body connected to at least one of said base plate and said suction channel, wherein the base plate has a lower face configured so as to be directed towards the surface to be vacuumed, and an opposite upper face, wherein the base plate channel comprises a front edge and a rear edge, wherein said lower face consists of a single surface delimited by a perimeter comprising a front side, a rear side and two lateral sides, said single surface being completely closed except said base plate channel which is the sole aperture configured to suck up dust and/or fluids and/or dirt from said surface to be vacuumed, wherein said base plate channel extends substantially through a whole width of said base plate and has closed ends in proximity of lateral sides of said base plate, wherein at least the surface of the lower face which extends along the whole front edge of the base plate channel and at least the surface of the lower face which extends along the whole rear edge of the base plate channel lie in a same plane; and wherein said base plate further comprises a front cavity configured to accommodate a front strip of velvet, the front cavity being spaced away from the front edge of the base plate channel.

9. The suction head of claim 8, wherein at least one further surface of the lower face not in the vicinity of the rear edge of the base plate channel lies in said same plane.

10. The suction head of claim 8, wherein at least one further surface of the lower face not in the vicinity of the front edge of the base plate channel lies in said same plane.

11. The suction head of claim 8, wherein substantially the entire surface of the lower face is flat and lies in said same plane.

12. The suction head of claim 8, further comprising a rear cavity in a base plate rear surface configured to accommodate a rear strip of velvet, the rear cavity being spaced away from the rear edge of the base plate channel, and wherein bottoms of the front cavity and the rear cavity are parallel to a plane of the base plate front surface and the base plate rear surface.

13. The suction head of claim 8, further comprising a base plate front surface and a base plate rear surface, and wherein the base plate front surface and the base plate rear surface are substantially perpendicular to the plane in which lie both the surface of the lower face which extends along the whole front edge of the base plate channel and the surface of the lower face which extends along the whole rear edge of the base plate channel.

14. The suction head of claim 8, further comprising a substantially triangular tooth formed on the front edge of the base plate channel to extend towards the base plate channel.

* * * * *